US009745762B2

(12) United States Patent
Moran

(10) Patent No.: US 9,745,762 B2
(45) Date of Patent: Aug. 29, 2017

(54) VERTICALLY RAISING SAFETY RAIL

(71) Applicant: Control Dynamics, Inc., Everett, WA (US)

(72) Inventor: Eric M. Moran, Camano Island, WA (US)

(73) Assignee: Control Dynamics, Inc., Everett, WA (US)

( * ) Notice: Subject to any disclaimer, the term of this patent is extended or adjusted under 35 U.S.C. 154(b) by 26 days.

(21) Appl. No.: 14/689,970

(22) Filed: Apr. 17, 2015

(65) Prior Publication Data

US 2016/0145881 A1 May 26, 2016

Related U.S. Application Data

(60) Provisional application No. 62/085,147, filed on Nov. 26, 2014.

(51) Int. Cl.

| | |
|---|---|
| ***E04G 5/14*** | (2006.01) |
| ***E04F 11/18*** | (2006.01) |
| ***E04G 21/32*** | (2006.01) |

(52) U.S. Cl.

CPC ..... *E04G 21/3228* (2013.01); *E04F 11/1865* (2013.01); *E04G 5/142* (2013.01); *E04F 2011/1876* (2013.01); *E04G 21/3266* (2013.01)

(58) Field of Classification Search

CPC E04G 21/32; E04G 5/14; E04G 5/142; E04G 21/3228; E04G 2005/148; E01F 13/00; E01F 13/04; E01F 13/046; E01F 13/048; E04H 5/06; E04F 11/1865

USPC ..... 182/113

See application file for complete search history.

(56) References Cited

U.S. PATENT DOCUMENTS

| | | | | |
|---|---|---|---|---|
| 984,063 A | | 2/1911 | Berg | |
| 2,753,224 A | | 7/1956 | Troche et al. | |
| 3,160,228 A | * | 12/1964 | De Witt Steed | E04G 1/22 108/147 |
| 3,309,086 A | * | 3/1967 | Viets | A63D 5/04 14/45 |

(Continued)

FOREIGN PATENT DOCUMENTS

| | | | |
|---|---|---|---|
| FR | 2699208 | | 6/1994 |
| NL | 1031600 | | 10/2007 |
| WO | WO 2012103579 | * | 8/2012 |

*Primary Examiner* — Daniel Cahn

(74) *Attorney, Agent, or Firm* — Lane Powell, P.C.

(57) ABSTRACT

A vertical raising safety rail having a moveable top rail, a base, a movable center rail assembly positioned above the base and below the top rail, a drive shaft, and a motor that provides rotational power to the drive shaft. The safety rail further includes a pair of spaced apart lower linkage arm assemblies that is operatively connected to the base and to the center rail assembly and configured to raise or lower the center rail assembly relative to the base when a rotational force is applied to the drive shaft. The safety rail also includes a pair of spaced apart upper linkage arm assemblies that is operably connected to the center rail assembly and to the top rail. The upper linkage arm assemblies are operably connected to corresponding lower linkage assemblies and are configured to move the upper rail relative to the center rail assembly. When the rotational force is reversed, the safety rail collapses into a compact footprint.

26 Claims, 14 Drawing Sheets

(56) References Cited

U.S. PATENT DOCUMENTS

| | | | | |
|---|---|---|---|---|
| 3,950,050 | A * | 4/1976 | Kinder | B66F 7/0666 108/147 |
| 4,782,914 | A * | 11/1988 | Nail | E04G 5/14 182/113 |
| 5,634,529 | A | 6/1997 | Nguyen et al. | |
| 8,267,380 | B1 * | 9/2012 | Dormeville | E01F 13/048 256/1 |
| 2003/0047382 | A1 * | 3/2003 | Panacci | E04G 5/00 182/113 |
| 2008/0150338 | A1 * | 6/2008 | Baum | A47C 3/38 297/311 |
| 2012/0079978 | A1 | 4/2012 | Teel | |
| 2012/0205604 | A1 * | 8/2012 | Gutierrez | E04G 21/3204 256/68 |

* cited by examiner

VERTICALLY RAISING SAFETY RAIL

RELATED APPLICATION

The present patent application claims priority to U.S. Provisional Patent Application Ser. No. 62/085,147, filed Nov. 26, 2014, and entitled "Vertically Raising Safety Rail."

TECHNICAL FIELD

The present invention relates to a vertically raising safety rail having a base, a moveable center rail assembly, and a moveable top rail with a pair of operably connected upper and lower linkage arms assemblies configured to move the center rail assembly relative to the base and the top rail relative to the center rail assembly. A motor provides a rotational force to a drive shaft that transmits a force to the lower linkage arm assemblies in order to move the center rail assembly and, in turn, the top rail. The invention is also capable of collapsing into a compact size.

BACKGROUND OF THE INVENTION

Safety rails are known and required as an OSHA requirement on industrial sites and a good safety tool. However, some applications where lifts are required to get to the work space make a traditional non moveable safety rail impractical or dangerous. A moveable safety rail system that vertically raises and lowers, depending on the application, is desirable and currently unknown.

BRIEF SUMMARY OF THE INVENTION

The present invention is directed to a vertically raising safety rail having a moveable top rail, a base, and a moveable center rail assembly that is positioned above the base and below the top rail. A pair of lower linkage arm assemblies is operably connected to the base and the center rail assembly and configured to move the center rail assembly relative to the base. A corresponding pair of upper linkage arm assemblies is operably connected to the center rail assembly and the top rail and configured to move the top rail relative to the center rail assembly. Each individual lower linkage arm assembly and corresponding upper linkage arm assembly are operably connected. The invention further includes a motorized drive shaft that transmits a rotational force to the lower linkage arms assemblies in order to move the lower linkage arm assemblies between the base and center rail assembly, thereby raising or lowering the center rail assembly. The upper linkage arm assemblies, being operably connected to the lower linkage arm assemblies, also move the top rail relative to the center rail. When the rotational force is reversed, the safety rail collapses into a compact footprint.

These and other advantages are discussed and/or illustrated in more detail in the DRAWINGS, the CLAIMS, and the DETAILED DESCRIPTION OF THE INVENTION.

BRIEF DESCRIPTION OF THE DRAWINGS

The accompanying figures, which are incorporated in and constitute a part of this specification, illustrate various exemplary embodiments.

DETAILED DESCRIPTION OF THE INVENTION

Figure 1:
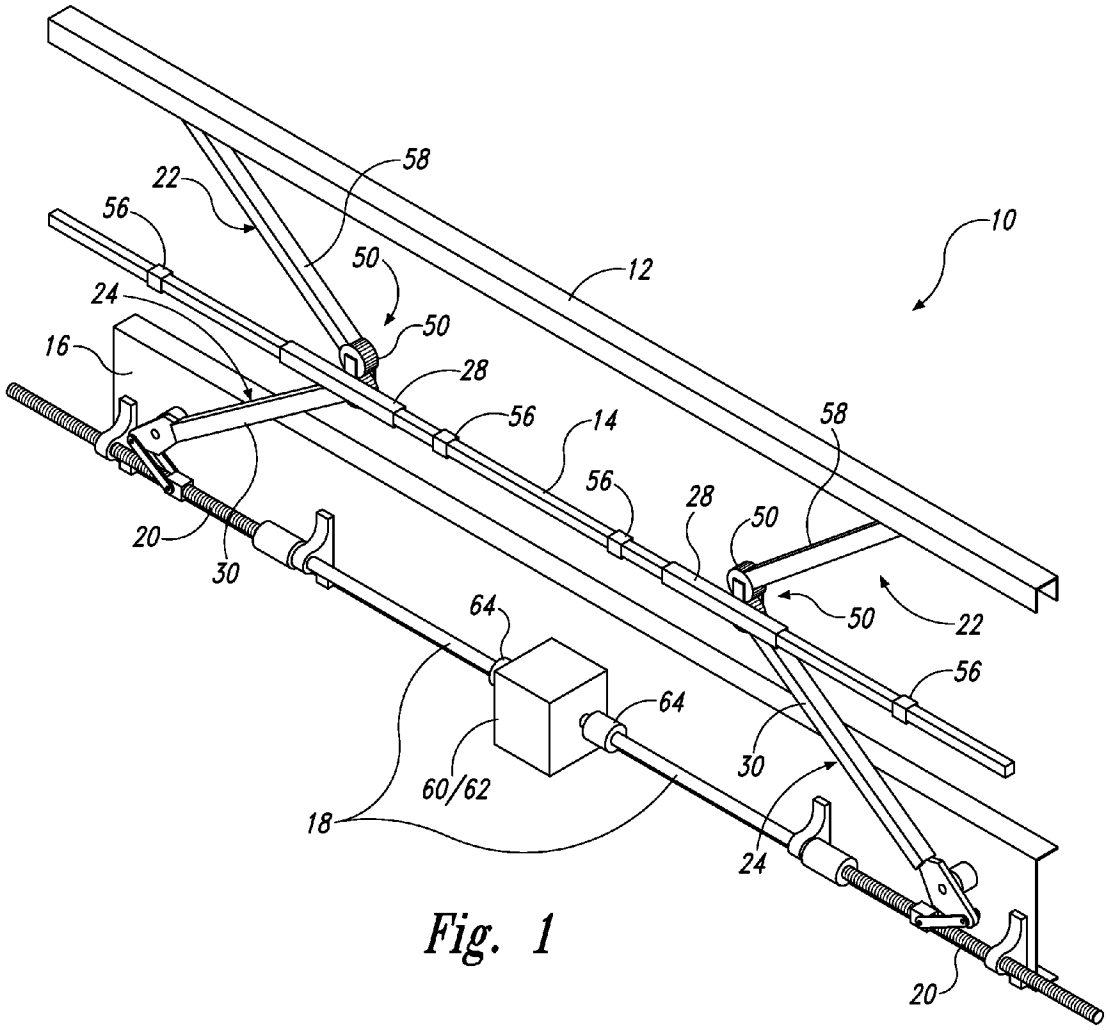
FIG. 1 is a rear isometric view of a vertically raising safety rail system of the present invention in the raised position; the safety rail system illustrating a top rail; a center rail assembly having a center rail, one or more optional slidable rail guide tube that receives and supports the center rail, and one or more optional rail stops; a base support; at least one drive shaft; and a pair of upper and lower linkage arm assemblies.

Referring to FIGS. 1-7, a collapsible safety rail 10 has a moveable top rail 12, a moveable center rail 14, a base 16 supporting a drive shaft 18 positioned between two threaded shafts 20, a pair of spaced apart rotating upper linkage assemblies 22, and a pair of spaced apart rotating lower linkage arm assemblies 24. Each upper linkage assembly 22 is operably connected to its corresponding lower linkage arm assembly 24 at a midpoint and is further connected to a slidable rail guide tube 28 that receives the center rail 14.

Figure 8:
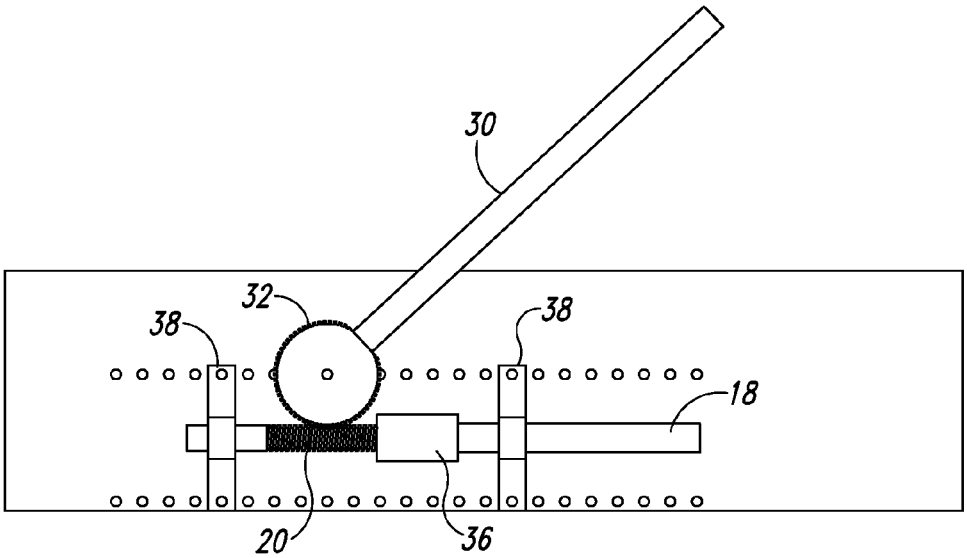
FIG. 8 is an enlarged rear view of a first embodiment lower linkage arm assembly in a raised position illustrating a worm gear in mating connection with a threaded shaft to obviate the need for a threaded nut and ball screw.
Figure 9:
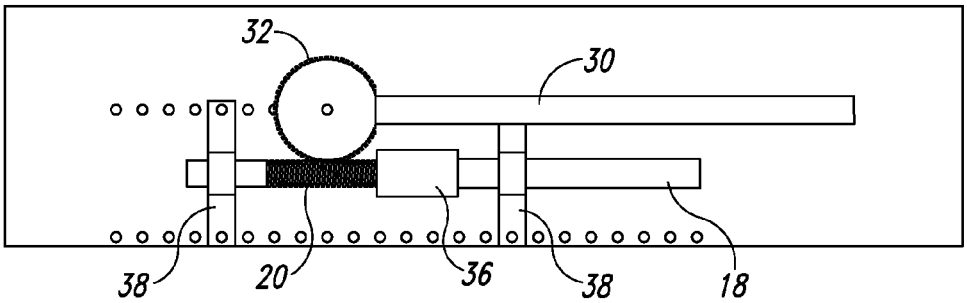
FIG. 9 is the same as FIG. 8 except illustrating the lower linkage arm assembly in the fully collapsed position.
Figure 10:
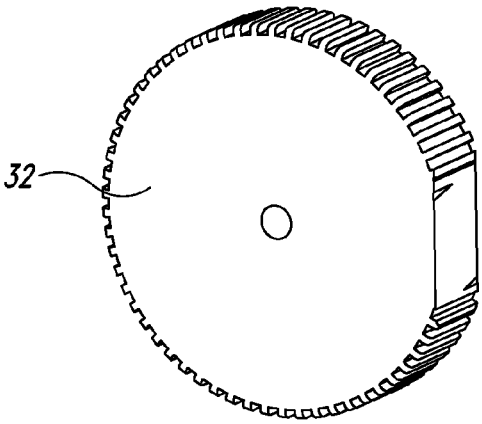
FIG. 10 is an enlarged rear perspective view of the worm gear.

Referring now to FIGS. 8, 9, and 10, a first embodiment lower linkage assembly includes a lower linkage arm 30 that is connected to a worm gear 32. The worm gear travels along its corresponding threaded shaft that is bordered by a drive shaft coupling 36 and a pillow support bracket 38. Rotational force is transferred to linear motion via the threaded shaft and the worm gear attached to the lower linkage arm.

Figure 11:
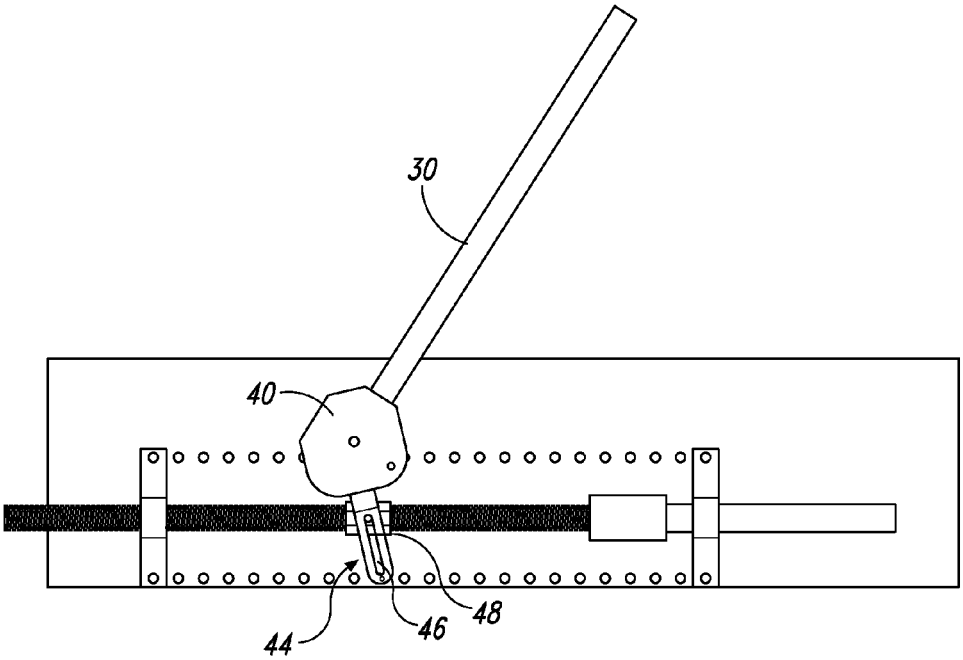
FIG. 11 is an enlarged rear view of a second embodiment lower linkage arm assembly in a raised position with an arm plate and fork bracket connected to a threaded nut/ball screw assembly.

Referring now to FIG. 11, a second embodiment lower linkage assembly includes an arm plate 40 that is connected to a fork bracket 44 that allows the shortened link arm to travel along the length of a slot 46 within the fork bracket 44. The fork bracket is connected to a ball screw and threaded nut assembly 48 that is capable of travelling the length of the unbounded threaded shaft 20. Each ball screw and threaded nut assembly 48 can travel up to 16 inches along the threaded shaft 20 with a preferred travel span of 12 inches. Here, rotational force is transferred to linear motion via the threaded shaft to the ball screw/threaded nut assembly to the fork bracket, arm plate and connected lower linkage arm.

Figure 12:
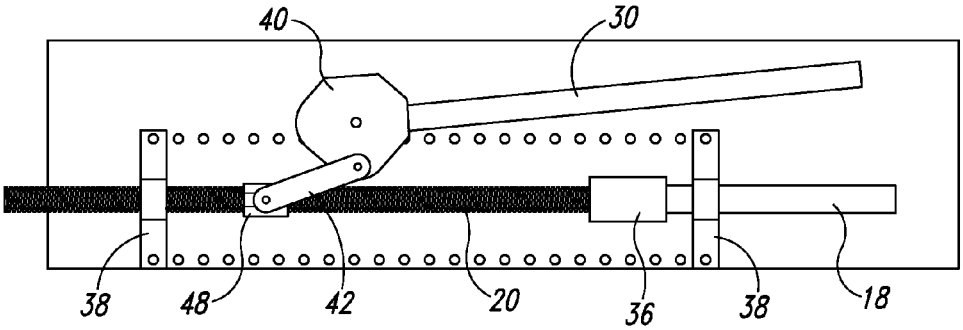
FIG. 12 is a rear perspective view of a third embodiment lower linkage arm assembly in a partially raised position illustrated with a drag linkage arm attached to the threaded nut/ball screw assembly.
Figure 13:
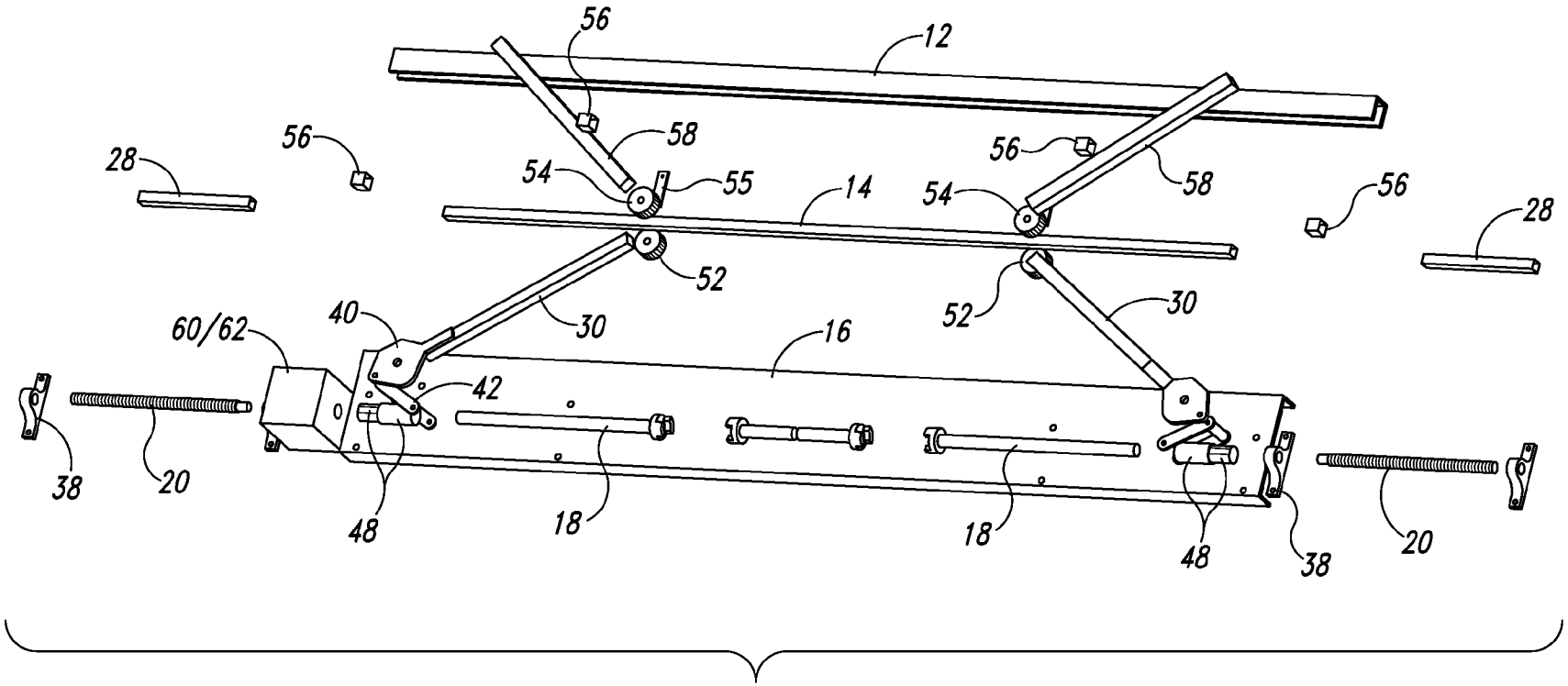
FIG. 13 is an exploded rear perspective view of the safety rail better illustrating the mesh gear assembly.

Referring now to FIG. 12, a third embodiment lower linkage assembly includes the arm plate 40 and linkage arm 30 as discussed above, but also includes a short drag linkage arm 42 that is connected to the ball screw/threaded nut assembly 48, also as discussed above. Here, rotational force is transferred to linear motion via the threaded shaft to the ball screw/threaded nut assembly to the short drag linkage arm to the arm plate and connected lower linkage arm.

Figure 19:
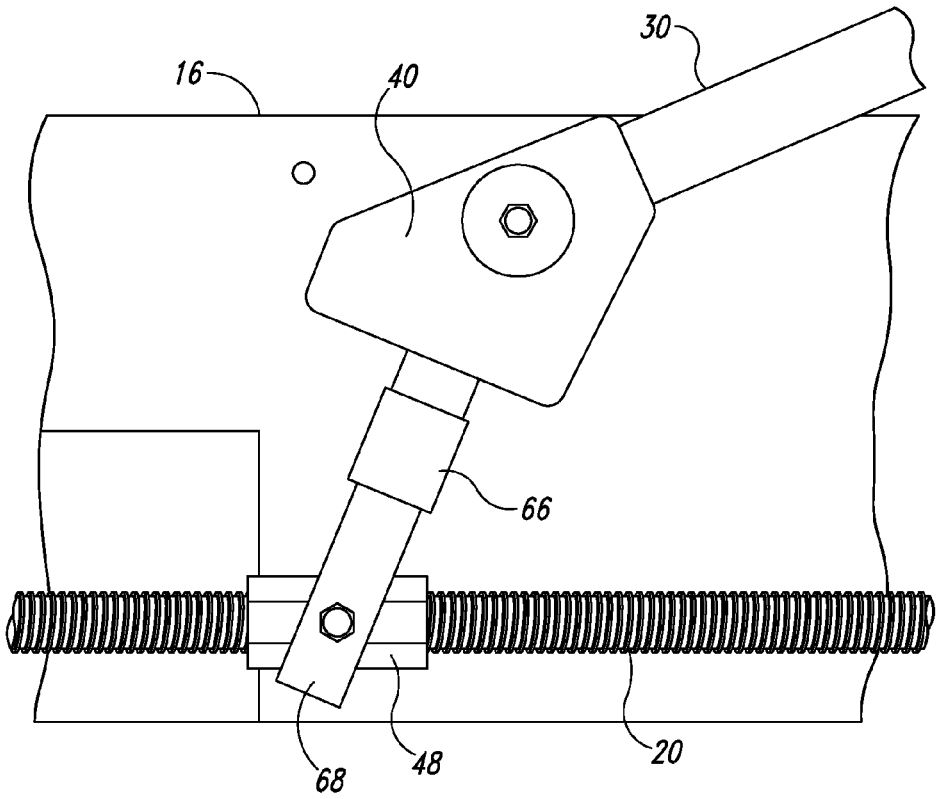
FIG. 19 is rear view of a fourth embodiment lower linkage arm assembly in a raised position with an arm plate and telescoping member and solid fork bracket connected to the threaded nut/ball screw assembly.

Referring now to FIG. 19, a fourth embodiment lower linkage arm assembly includes an arm plate 40 connected to a linkage arm 30 as discussed above. But instead of a short drag linkage arm 42 or slotted fork bracket 44 of FIGS. 12 and 11, respectively, the arm plate is connected to a short telescoping member 66 attached to a solid fork bracket 68 that is attached to the ball screw/threaded nut assembly 48.

Referring now to FIGS. 20-24, a fifth embodiment lower linkage arm assembly includes an arm plate 40 connected to a linkage arm 30 as discussed above and also includes a short drag linkage arm 42 that is attached the ball screw/threaded nut assembly 48. Here, though, the rotation function is effectuated though a double tapered bearing 41 that is integrated into lower linkage arm assembly.

Figure 14:
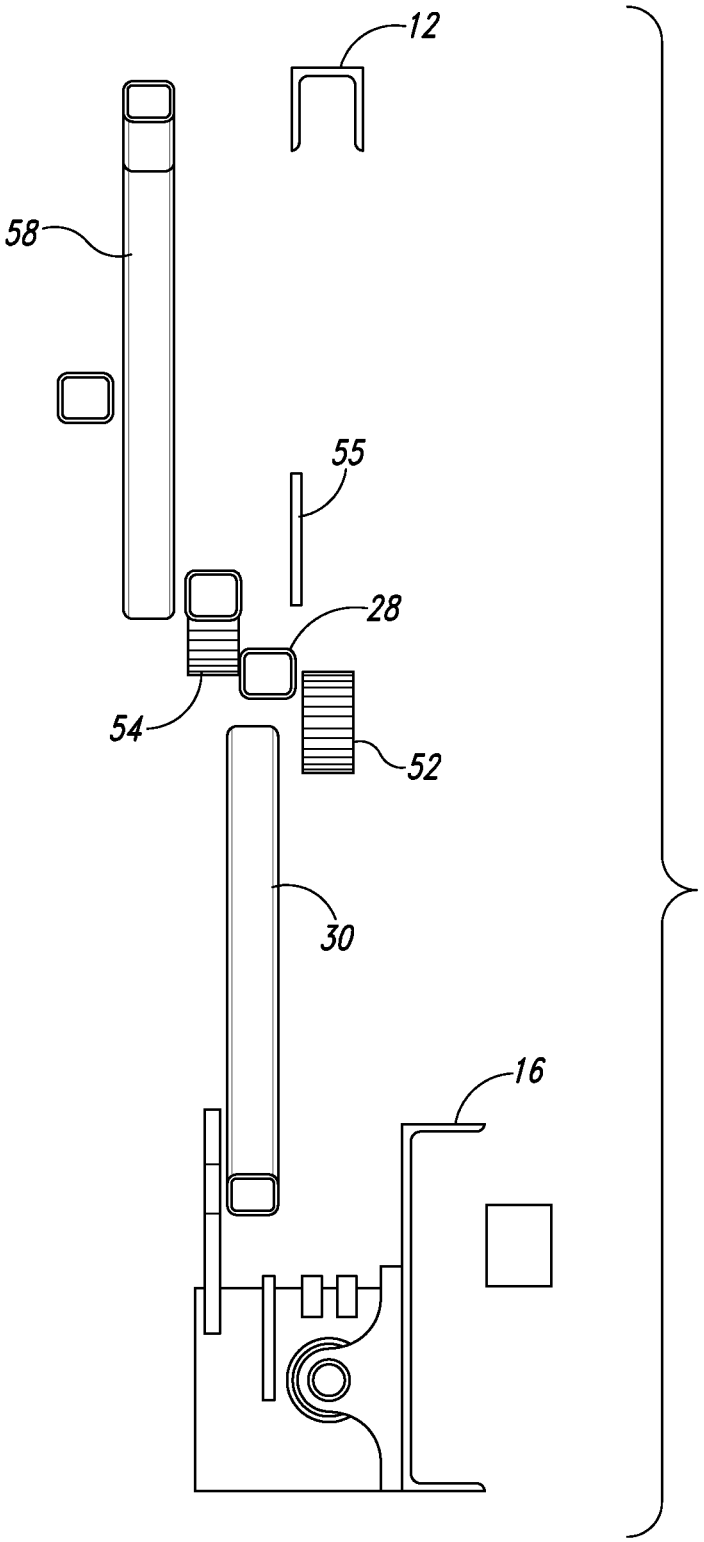
FIG. 14 is a side view of the exploded safety rail of FIG. 13.
Figure 15:
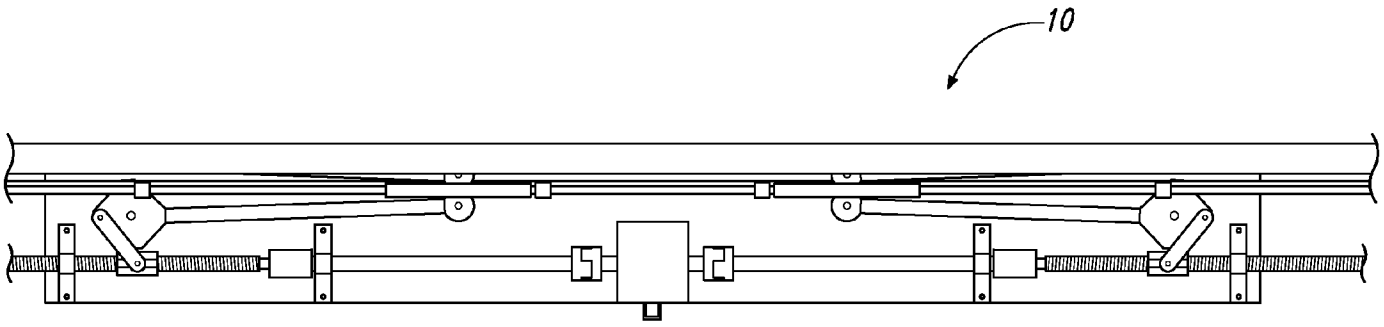
FIG. 15 is a rear view of the safety rail in the fully collapsed position.

Referring again to FIGS. 1-7, as well as FIGS. 13, 14, 20, 21, and 24, each lower linkage arm 30 is attached to its corresponding upper linkage assembly through a midpoint mesh gear assembly 50, which includes two meshed gears: a lower mesh gear 52, and an upper mesh gear 54, as well as a gear plate 55. As best illustrated in FIG. 14, each set of two gears 52, 54 and corresponding gear plate 55 is positioned about and connected to a corresponding rail guide tube 28 in which the center rail 14 is support and lifted when the linkages arms rotate.

Referring also to FIGS. 15-18, each upper linkage arm 22 includes an upper linkage arm 58 that is connected to upper mesh gear 54 at a lower end of the upper linkage arm. An upper end of the linkage arm 58 is connected to top rail 12. In use, the mesh gear assembly 50 functions like an elbow respective to upper linkage arm 58 and lower linkage arm 30 that allows the upper and lower linkage arms to form an angle $\alpha$ that ranges from 0 degrees (fully collapsed position) to 150 degrees (fully raised position) or any position therebetween. The mesh gear assembly maintains chocking of the upper and lower linkage arms and the level nature of the top and center rail.

Any rotational force in one direction (e.g., clockwise) may be applied to the drive shaft, which will transfer torque to the threaded shaft, and thereby to the threaded screw. In this manner, the ball screw turns rotational motion to linear motion via the threaded nut. The threaded screw will rotate the nut to move in a linear direction. The nut moves the short linkage arm, which rotates (and raises) the lower linkage arm 30. This raising of the lower linkage arm will also simultaneously turn lower mesh gear 52, which is joined and attached to upper mesh gear 54. This will force angle $\alpha$ between the linkage arms to increase. The movement of the mesh gear assembly, which is connected to slidable rail guide tube 28, forces the rail guide tube to move inwardly along center rail 14. Rail stops 56 are positioned along center rail to stop the rail guide tube from moving too far and causing rail instability. Upper linkage arm 50 rotates upwardly as upper mesh gear 54 is turned, which raises upper rail 12 as the outer end of the upper linkage arm is attached to upper rail 12 via pins or other fasteners.

Figure 20:
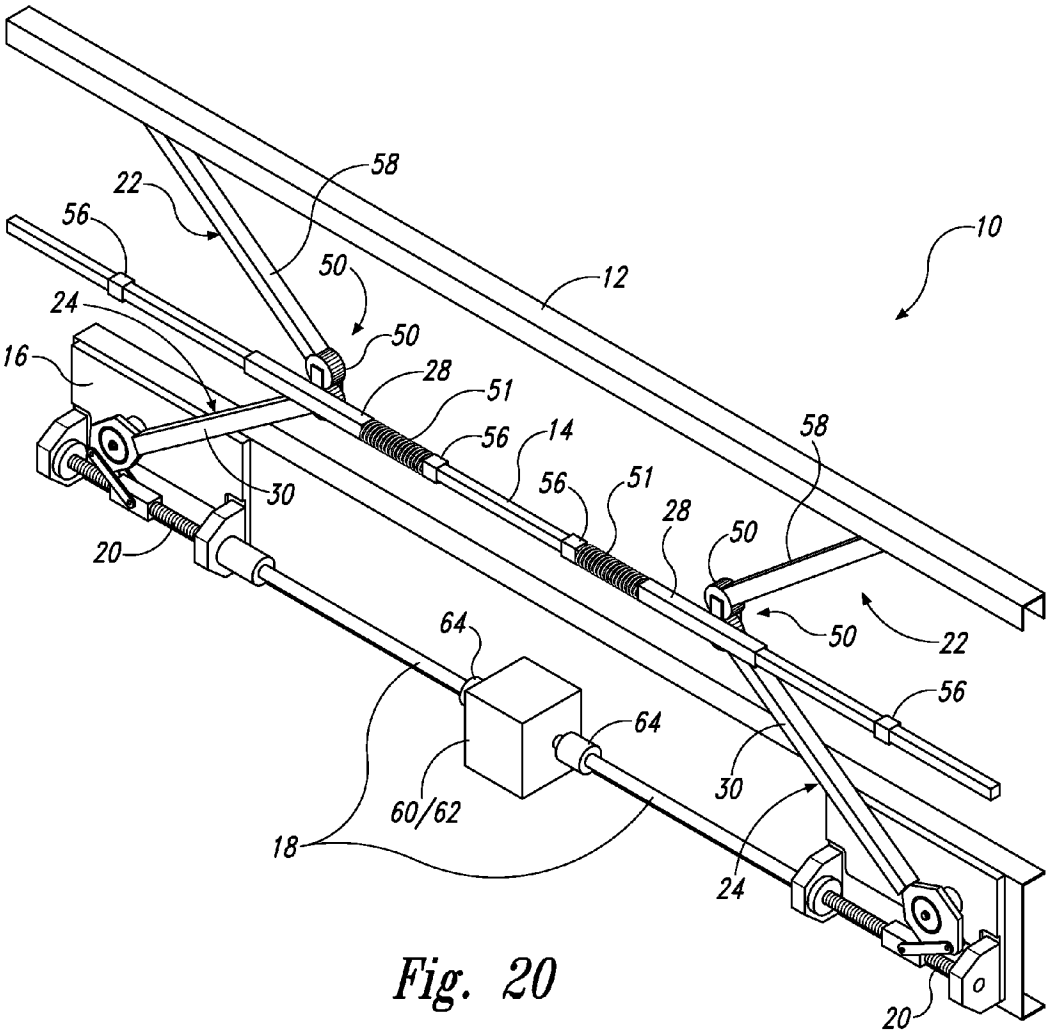
FIG. 20 is a rear isometric view like FIG. 1 except illustrating optional springs between the optional slidable guide rails and optional rail stops and illustrating a fifth embodiment lower linkage arm assembly in raised position with rail bearing assembly, linkage arm, and threaded nut/ball screw assembly.
Figure 21:
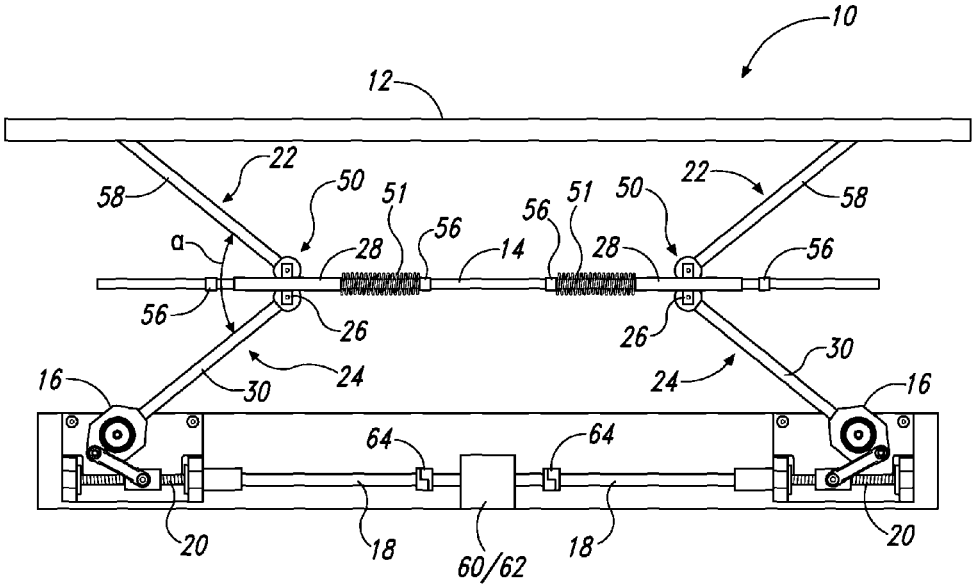
FIG. 21 is a rear view of FIG. 20.
Figure 22:
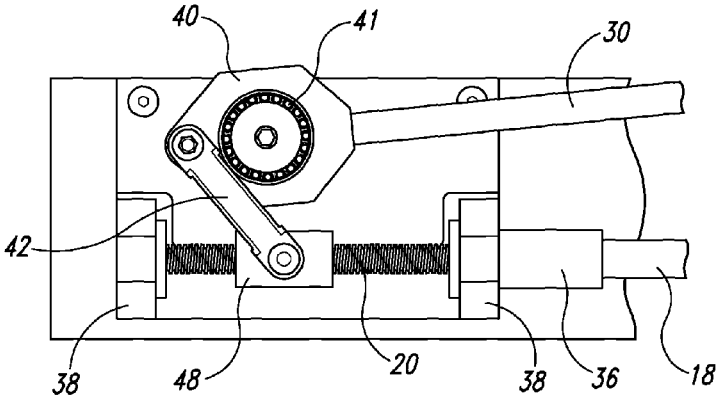
FIG. 22 is an enlarged rear view of the fifth embodiment lower linkage arm assembly in the nearly collapsed position.
Figure 23:
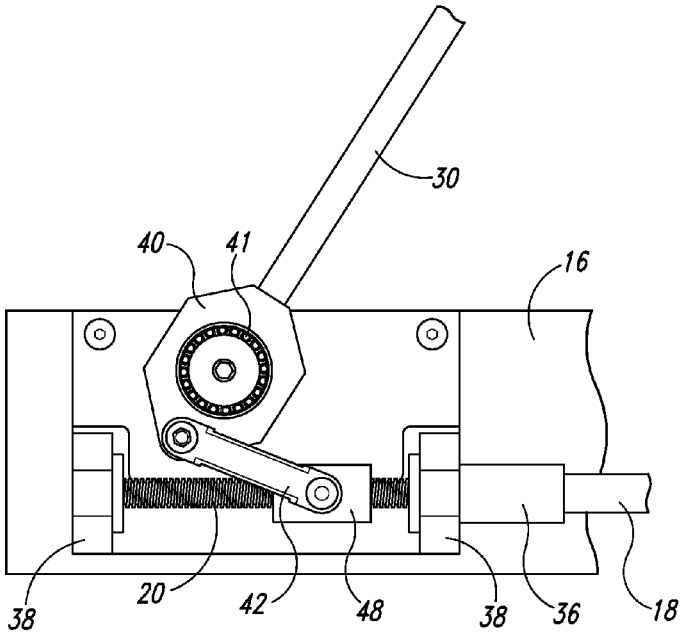
FIG. 23 is an enlarged rear view of the fifth embodiment lower linkage arm assembly in the nearly fully raised position.
Figure 24:
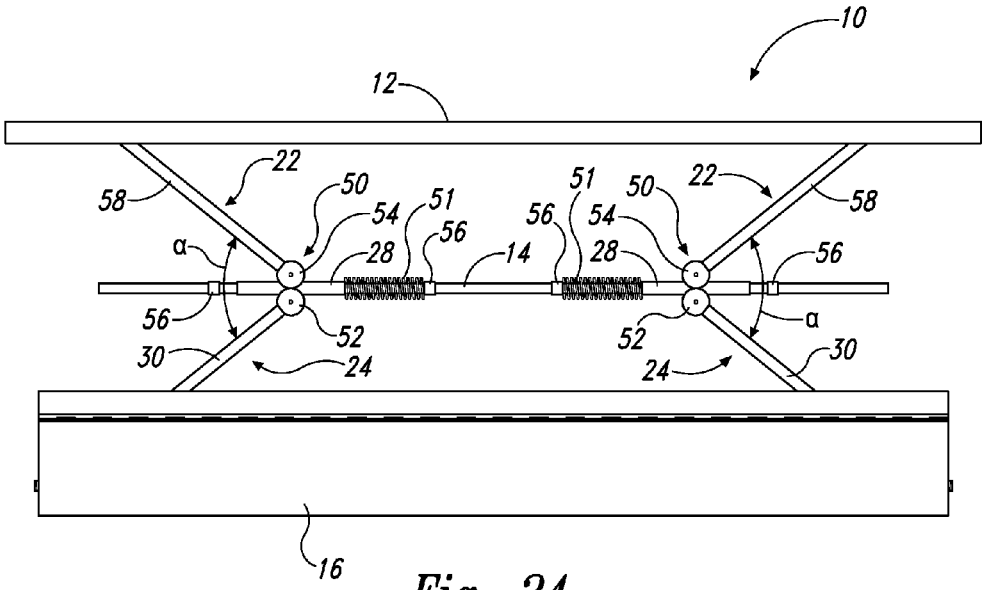
FIG. 24 is a front view of the safety rail of FIG. 20.

As illustrated in FIGS. 20, 21, and 24 optional rail springs 51 may be positioned between the rail guide tube and the rail stop to put tension on the rail guide tube and upper and lower linkage arm assemblies to better hold a vertically upright position. The rail springs keep the center rail aligned with the top rail to prevent "walking" back and forth during motion.

Figure 16:
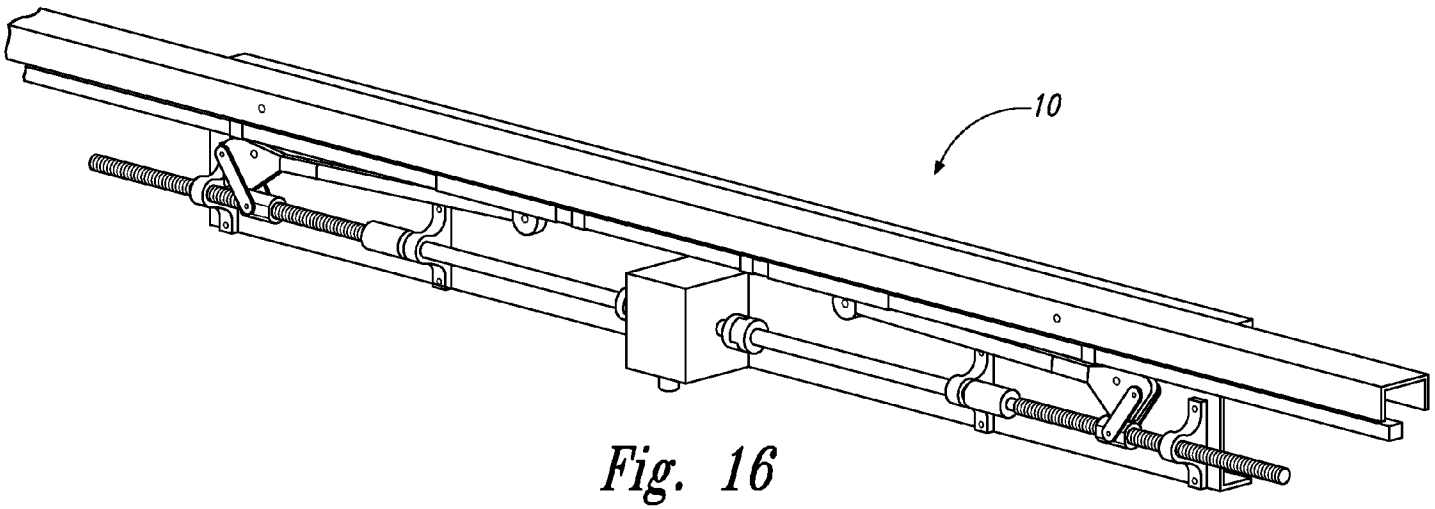
FIG. 16 is a rear perspective view of the safety rail in a slightly raised position.
Figure 17:
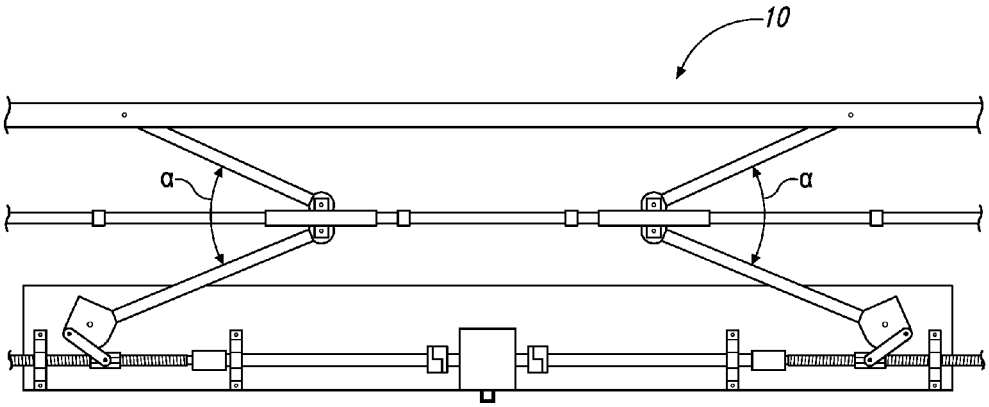
FIG. 17 is a rear view of the safety rail in a partially raised position.
Figure 18:
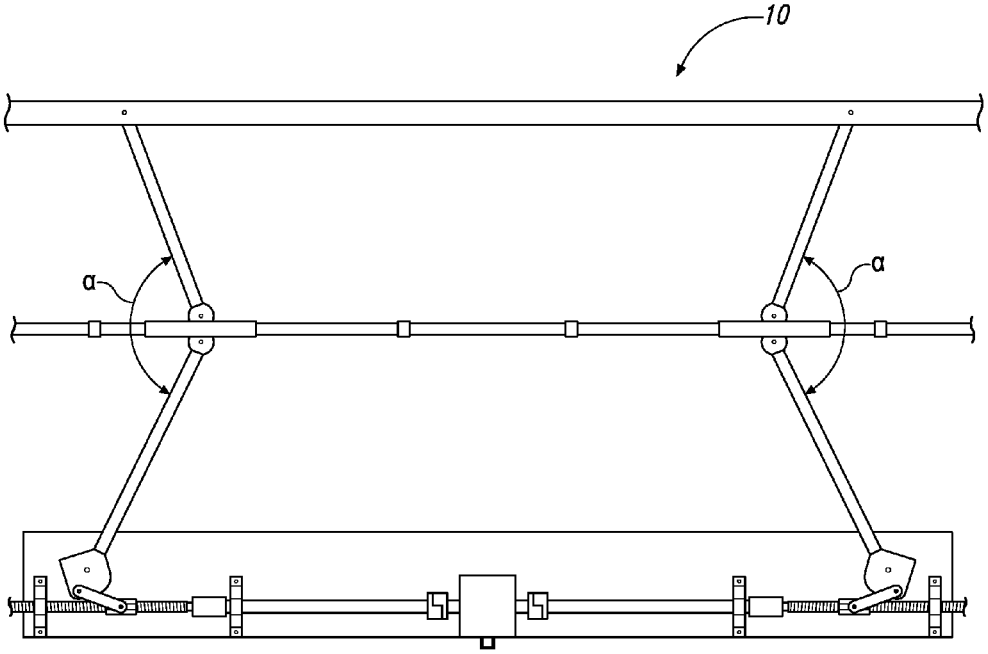
FIG. 18 is a rear view of the safety rail in the fully raised position.

A rotational force in the other direction (e.g., counter clockwise) will rotate the threaded shaft and, therefore the ball screw and threaded nut and all connected linkages, in the reverse direction. The ball screw and threaded nut will move the worm gear and move the short linkage arm 42, and rotate the lower linkage arm 30 so that the lower mesh gear moves in the reverse direction with the upper mesh gear. This action decreases angle $\alpha$ so that the top rail and center rail lower as much as desired. When the rotational force stops, the safety rail maintains its position as of that time. When the safety rail is fully collapsed, the center rail is tucked under the top rail, such as illustrated in FIG. 16, for storage purposes.

In one form of the invention, a motor 60 is added to drive shaft 18. Drive shaft 18 may be in two pieces as illustrated in FIGS. 1-7 with the motor being placed therebetween to rotate each drive shaft. The motor may be pneumatic (e.g., an air motor), electrical, hydraulic, or magnetic.

The invention is adaptable for explosion proof applications, such as painting in a large manufacturing facility. Air motors, (such as explosion proof C1D1 air motors) are particularly suited for explosion proof applications, such as painting airplane parts. An operator with a manual pneumatic valve delivers air pressure to two inputs (orifices) on the air motor. Air pressure to the first input raises the safety rail as described above. Air pressure to the second input lowers the safety rail as described above. In such an air motor application, a rotating air motor shaft transfers rotational force to a drive belt through two cogged pulleys and a cogged belt (not illustrated). Rotational force is transferred to the drive shaft (or drive shafts) via a second cogged pulley (also not illustrated).

Figure 2:
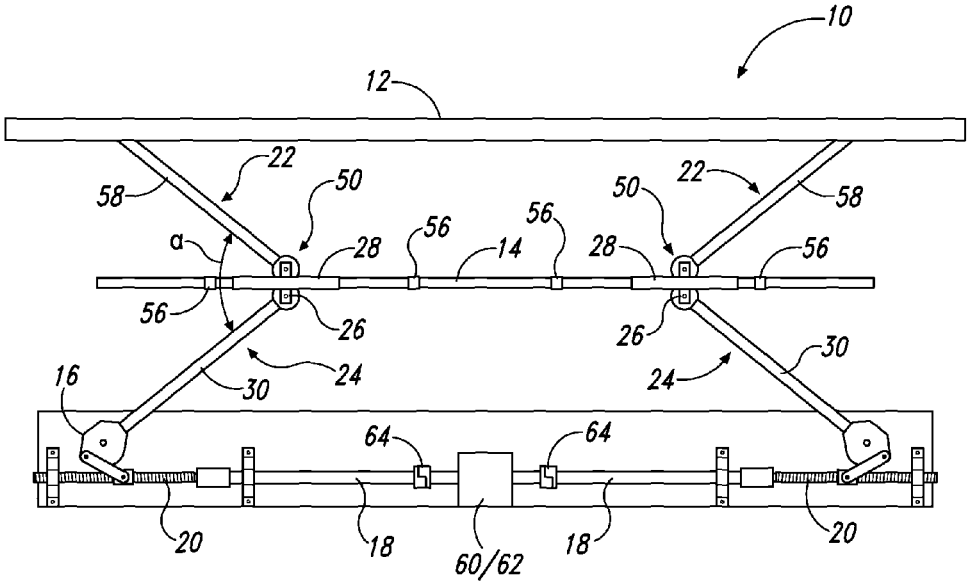
FIG. 2 is a rear view of the safety rail system of FIG. 1.
Figure 3:
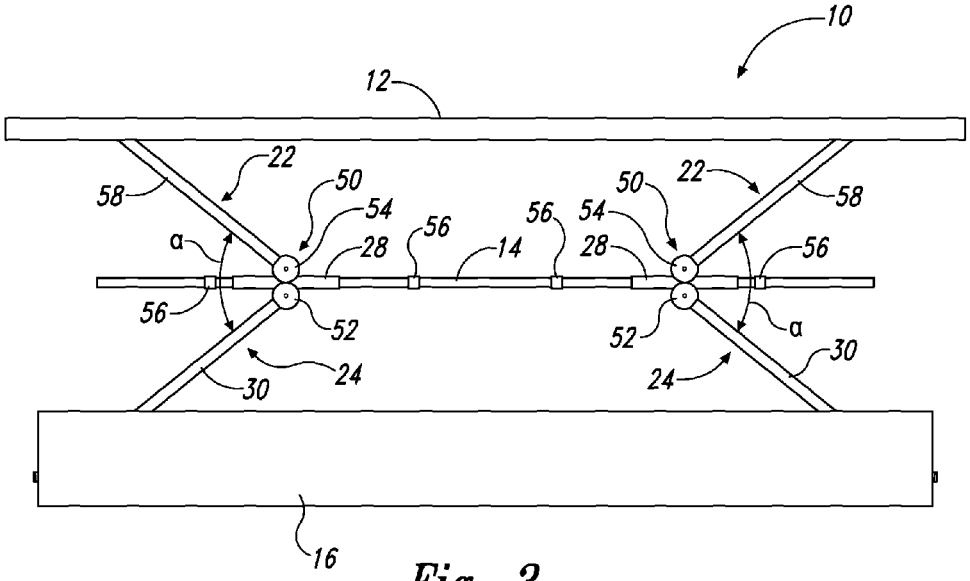
FIG. 3 is a front view of the safety rail system of FIG. 1.
Figure 4:
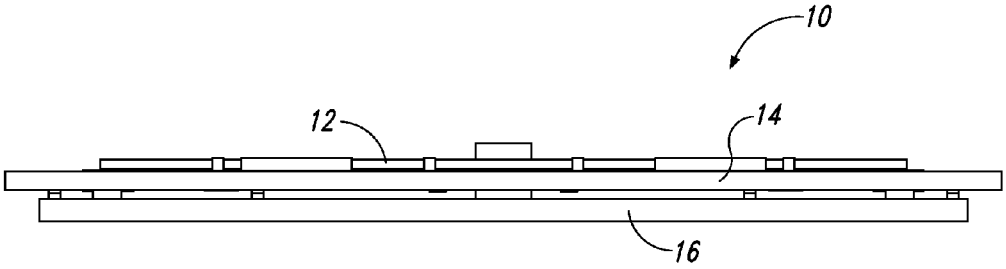
FIG. 4 is a top view of the safety rail system of FIG. 1.
Figure 5:
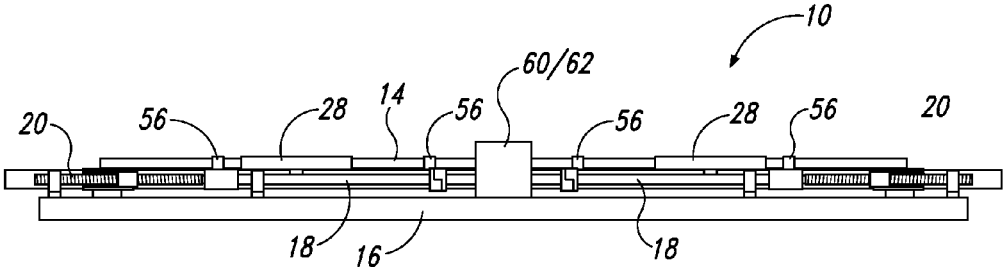
FIG. 5 is a bottom view of the safety rail system of FIG. 1.
Figure 6:
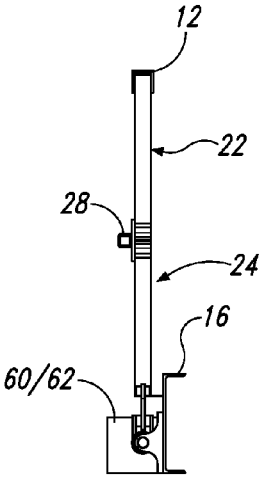
FIG. 6 is a left side view of the safety rail system of FIG. 1.
Figure 7:
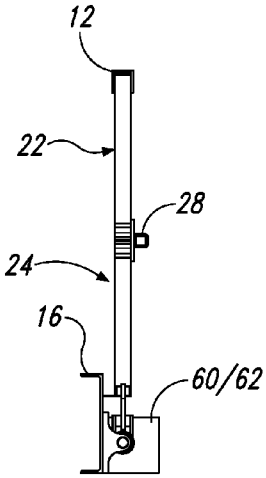
FIG. 7 is a right side view of the safety rail system of FIG. 1.

An optional speed reducer 62 may be added. A pair of reducer couplers 64 may be positioned between the speed reducer 62 and the two drive shafts (as illustrated in FIGS. 1 and 2).

Figure 25:
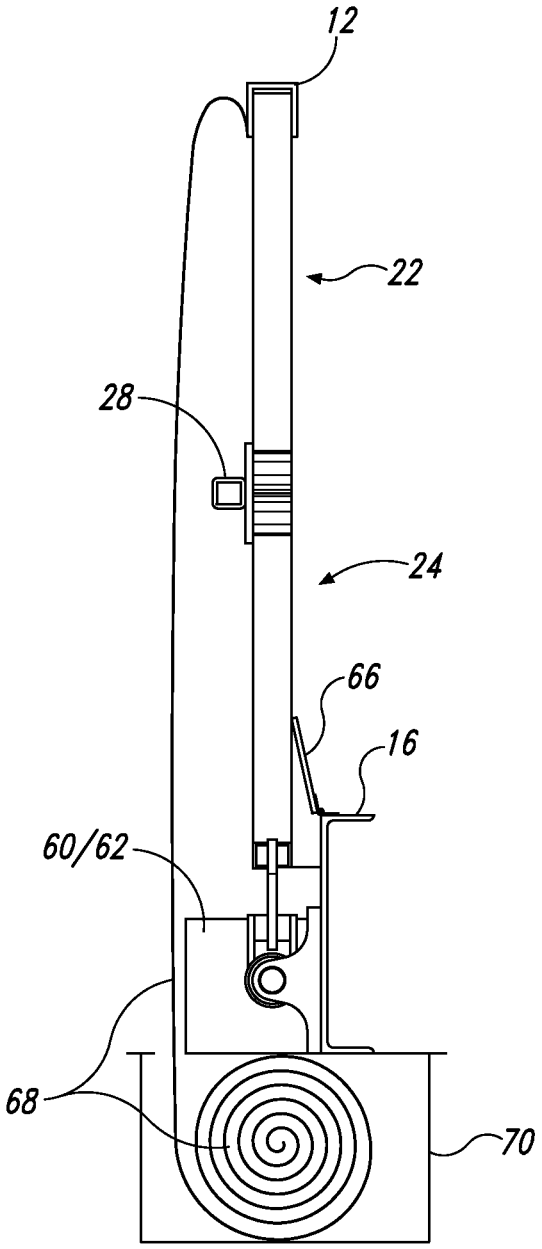
FIG. 25 is a is a side view illustrating an optional kick plate operably connected to the base and an optional curtain that is operably connected to a portion of the base and the top rail and raises and lowers when the safety rail is raised or lowered.

Referring to FIG. 25 an optional kick plate 66 make be added to the base. The kick plate will rotate or slide vertically during employment. Further, an optional raisable safety curtain 68 may be interconnected to base 16, such as through a box 70 attached to base 16. The safety rail is curled up in the box and unrolls out through a slot and is attached to the top rail. The safety curtain raises when the safety rail is raised and curls back in its box when the safety rail is collapsed and can be attached on either side.

The safety rail system can be adapted for industrial use, commercial use, and residential use (both indoors and outdoors). Indoor residential applications can be made from lightweight materials and made in a smaller configuration to function as a pet or child gate.

What is claimed is:

1. A vertically raising safety rail comprising:

a moveable top rail;

a base;

a moveable center rail assembly positioned above the base and below the top rail;

a drive shaft;

a motor that provides rotational power to the drive shaft;

a pair of spaced apart lower linkage arm assemblies that is operably connected to the base and to the center rail assembly; said pair of lower linkage arm assemblies being movable relative to the base and the center rail assembly when a rotational force is applied to the drive shaft and configured to move the center rail assembly relative to the base; and a pair of spaced apart rotating upper linkage arm assemblies that is operably connected to the center rail assembly and the top rail; said pair of upper linkage arm assemblies operably movable relative to the lower linkage arm assemblies to move the top rail relative to the center rail assembly;

wherein each said lower linkage arm assembly is operably connected to its corresponding said upper linkage arm assembly at a midpoint mesh gear assembly which has gears connected by a gear plate directly connected to a center rail of the moveable center rail assembly.

2. The safety rail of claim 1 wherein the center rail includes a tubular center rail and is received into at least one guide tube and to which the midpoint mesh gear assembly is attached.

3. The safety rail of claim 1 wherein the drive shaft is operably coupled to the base.

4. The safety rail of claim 1 wherein the rotational force from the drive shaft is transferred to linear motion to each lower linkable arm assembly through a worm gear, a corresponding threaded shaft, a drive shaft coupling, and a pillow support bracket.

5. The safety rail of claim 1 wherein the rotational force from the drive shaft is transferred to linear motion to each lower linkage arm assembly through an arm plate and fork bracket including a slot, said fork bracket operably connected to a ball screw and threaded nut assembly.

6. The safety rail of claim 1 wherein each said lower linkage arm assembly is configured to accept rotational force and move linearly through an arm plate, linkage arm, and a drag linkage arm operably connected to a ball screw and threaded nut assembly.

7. The safety rail of claim 1 wherein the rotational force from the drive shaft is transferred to linear motion to each lower linkage arm assembly through a telescoping member attached to a fork bracket to which a ball screw and threaded nut assembly is operably connected.

8. The safety rail of claim 1 wherein the motor is selected from the group consisting of: pneumatic, electrical, hydraulic, and magnetic.

9. The safety rail of claim 1 wherein the drive shaft comprises two separate drive shaft members.

10. The safety rail of claim 1 further comprising one or more speed reducers.

11. The safety rail of claim 1 wherein the top rail is configured to cover over the center rail assembly and closely confront the base when the rotational force is reversed.

12. The safety rail of claim 1 further comprising a kick plate operatively connected to the base.

13. The safety rail of claim 1 further comprising a raisable safety curtain having an upper end and a bottom end where the upper end of the safety curtain is operably interconnected to the top rail and the bottom end of the curtain is interconnected to the base of the safety rail.

14. The safety rail of claim 1 wherein the center rail includes a tubular center rail and is received into at least one guide tube.

15. The safety rail of claim 14 further comprising one or more rail stops that are positioned along the tubular center rail to form a barrier along the tubular center rail to the at least one guide tube.

16. The safety rail of claim 15 further comprising one or more rail springs positioned between the guide tube and said on or more rail stops.

17. A method comprising:

providing the vertically raising safety rail of claim 1; and applying the rotational force.

18. The method of claim 17 wherein the motor is selected from the group consisting of: pneumatic, electrical, hydraulic, and magnetic.

19. The safety rail of claim 1 wherein the rotational force from the drive shaft is transferred to linear motion to each lower linkage arm assembly through an arm plate and a double tapered bearing assembly, linkage arm, and a short drag linkage arm operably connected to a ball screw and threaded nut assembly.

20. A vertically raising safety rail comprising:

a moveable top rail;

a base;

a moveable center rail assembly positioned above the base and below the top rail;

a drive shaft;

a motor that provides rotational power to the drive shaft;

a pair of spaced apart lower linkage arm assemblies that is operably connected to the base and to the center rail assembly; said pair of lower linkage arm assemblies being movable relative to the base and center rail assembly when a rotational force is applied to the drive shaft;

a pair of spaced apart rotating upper linkage arm assemblies that is operably connected to the center rail assembly and the top rail; said pair of upper linkage arm assemblies operably movable relative to the lower linkage arm assemblies; and means for transmitting the rotational force to the pair of lower linkage arm assemblies into linear motion;

wherein each said lower linkage arm assembly is operably connected to its corresponding said upper linkage arm assembly at a midpoint mesh gear assembly which has gears connected by a gear plate directly connected to a center rail of the moveable center rail assembly.

21. The safety rail of claim 20 wherein the motor is selected from the group consisting of: pneumatic, electrical, hydraulic, and magnetic.

22. A vertically raising safety rail comprising:

a base;

a top rail configured to be movable relative to the base;

a center rail assembly configured to be positioned above the base and below the top rail and moveable relative to the base and the top rail;

a drive shaft assembly including a threaded shaft configured to impart a rotational force;

a motor configured to provide a rotational power to the threaded shaft;

a pair of spaced apart lower linkage arm assemblies configured to convert the rotational force to a linear force; said lower linkage arm assemblies configured to be operably connected to the base and to the center rail assembly; said pair of lower linkage arm assemblies configured to move the center rail assembly relative to the base when the rotational force is applied to the drive shaft assembly and converted to the linear force in order to move the lower linkage arm assemblies; and a pair of spaced apart rotating upper linkage arm assemblies configured to be operably connected to the center rail assembly and to the top rail; said pair of upper linkage arm assemblies are configured to be moved by the lower linkage arm assemblies in order to move the top rail relative to the center rail assembly;

wherein each said lower linkage arm assembly is operably connected to its corresponding said upper linkage arm assembly at a midpoint mesh gear assembly which has gears connected by a gear plate directly connected to a center rail of the center rail assembly.

23. The safety rail of claim 22 wherein the rotational force is configured to be transferred to linear motion from the threaded shaft to a ball screw on the lower linkage arm assemblies.

24. The safety rail of claim 22 wherein the rotational force is configured to be transferred to linear motion from the threaded shaft to a worm gear on the lower linkage arm assemblies.

25. A vertically raising safety rail comprising:

a base;

a top rail configured to be movable relative to the base;

a center rail assembly configured to be positioned above the base and below the top rail and moveable relative to the base and the top rail;

a drive shaft configured to be positioned adjacent the base;

a motor configured to provide a rotational power to the drive shaft;

a pair of spaced apart lower linkage arm assemblies configured to be operably connected to the base and to the center rail assembly; said pair of lower linkage arm assemblies configured to move the center rail assembly relative to the base when a rotational force is applied to the drive shaft and move the center rail assembly relative to the base; and a pair of spaced apart rotating upper linkage arm assemblies configured to operably connect the center rail assembly to the top rail; said pair of upper linkage arm assemblies configured to operably be moved by the lower linkage arm assemblies in order to move the top rail relative to the center rail assembly;

wherein each said lower linkage arm assembly is operably connected to its corresponding said upper linkage assembly at a midpoint mesh gear assembly which has gears connected by a gear plate directly connected to a center rail of the center rail assembly.

26. A vertically raising safety rail comprising:

a base;

a top rail configured to be movable relative to the base and having a downwardly shaped channel;

a center rail assembly configured to be positioned above the base and below the top rail and moveable relative to the base and top rail;

a drive shaft;

a motor configured to provide rotational power to the drive shaft;

a pair of spaced apart lower linkage arm assemblies configured to be operably connected to the base and to the center rail assembly; said pair of lower linkage arm assemblies configured to be movable relative to the base and the center rail assembly when a rotational force is applied to the drive shaft and configured to move the center rail assembly relative to the base; and a pair of spaced apart rotating upper linkage arm assemblies configured to be operably connected to the center rail assembly and to the top rail; said pair of upper linkage arm assemblies configured to be operably moved by the lower linkage arm assemblies in order to move the top rail relative to the center rail assembly;

wherein the top rail and the center rail assembly are configured to collapse where the downwardly shaped channel of the top rail covers the center rail assembly and the base to form a collapsed safety rail; and wherein each said lower linkage arm assembly is operably connected to its corresponding said upper linkage assembly at a midpoint mesh gear assembly which has gears connected by a gear plate directly connected to a center rail of the center rail assembly.

* * * * *